US008783199B2

(12) United States Patent
Shih Cion Shen

(10) Patent No.: US 8,783,199 B2
(45) Date of Patent: Jul. 22, 2014

(54) MODULAR FLOATING PLATFORM SYSTEM

(75) Inventor: Bernardo Shih Cion Shen, Porto Alegre - RS (BR)

(73) Assignee: Indústria Mecânica NTC Ltda., Caxias do Sul, RS (BR)

( * ) Notice: Subject to any disclaimer, the term of this patent is extended or adjusted under 35 U.S.C. 154(b) by 335 days.

(21) Appl. No.: 13/276,072

(22) Filed: Oct. 18, 2011

(65) Prior Publication Data

US 2012/0260841 A1 Oct. 18, 2012

(30) Foreign Application Priority Data

Apr. 15, 2011 (BR) ..... 9100008 U

(51) Int. Cl.
*B63B 35/34* (2006.01)
*B63B 35/38* (2006.01)
*B63B 35/44* (2006.01)

(52) U.S. Cl.
USPC ..... 114/266; 114/267

(58) Field of Classification Search
CPC ..... B63B 35/34; B63B 35/38; B63B 35/44; B63B 35/58; B63B 2737/00; B63B 3/06; B63C 1/02; B63C 1/04; B63C 1/06; E02B 3/064
USPC ..... 114/263, 264, 266, 267; 405/218–220; D12/316, 317
See application file for complete search history.

(56) References Cited

U.S. PATENT DOCUMENTS

| | | | | |
|---|---|---|---|---|
| 5,251,560 | A * | 10/1993 | Ban et al. | 114/266 |
| 5,529,013 | A | 6/1996 | Eva, III et al. | |
| 6,033,151 | A * | 3/2000 | Tsou | 405/219 |
| 7,117,809 | B2 * | 10/2006 | Lamoureux et al. | 114/263 |
| 7,213,531 | B2 | 5/2007 | Ahern | |
| 7,426,898 | B1 | 9/2008 | Ahern | |
| 8,037,837 | B2 * | 10/2011 | La Violette et al. | 114/263 |

FOREIGN PATENT DOCUMENTS

| | | | | |
|---|---|---|---|---|
| EP | 385903 | A1 * | 9/1990 | B63B 35/38 |
| JP | 01273783 | A * | 11/1989 | B63B 35/38 |
| JP | 01273784 | A * | 11/1989 | B63B 35/38 |

* cited by examiner

*Primary Examiner* — Ajay Vasudeva
(74) *Attorney, Agent, or Firm* — Duane Morris LLP

(57) ABSTRACT

A modular floating platform system includes parallelepiped-shaped floating blocks, each floating block (1) having rings (2), cavities (3) and projections (4) on the lateral faces. The projections (4) are mated with the cavities (3) on the lateral faces of the adjacent floating blocks (1), and pins are inserted into corresponding rings (2), to assemble the floating platform.

7 Claims, 12 Drawing Sheets

MODULAR FLOATING PLATFORM SYSTEM

Figure 1:
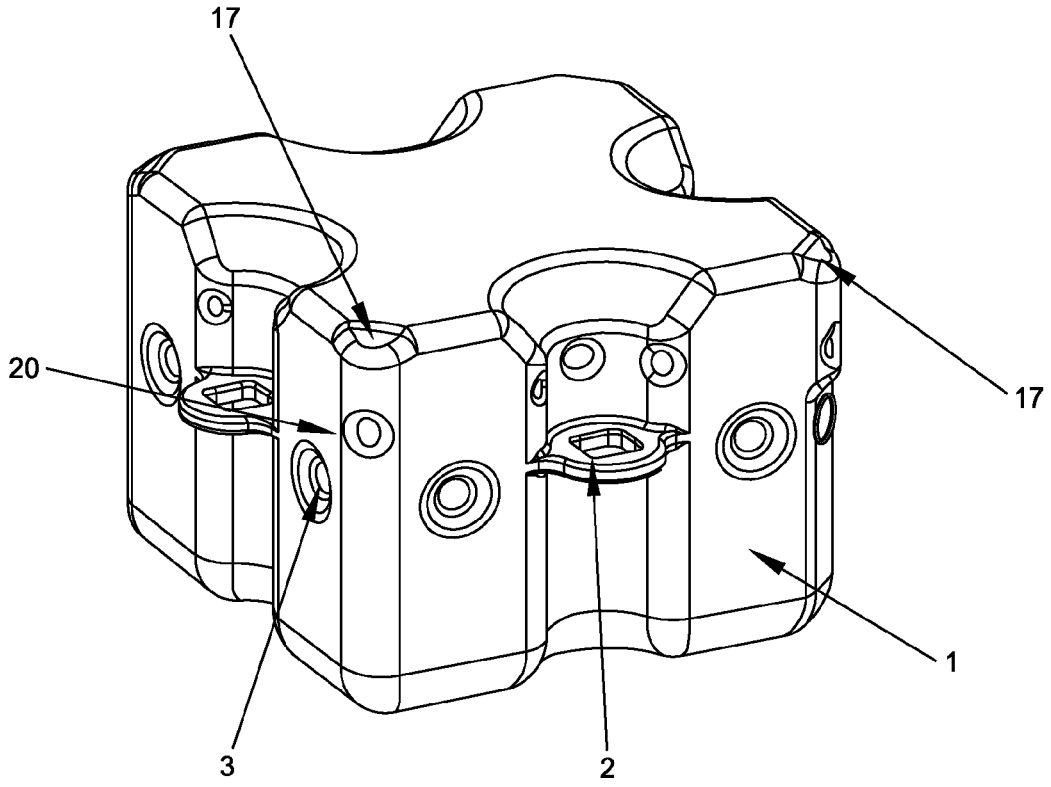

This report refers to an innovative assembling system for floating platforms. Such system is used in platforms with floating, plastic-made, rectangular modules, also known as "pier". As a highlight from the inventive point of view, we should remark the new disposition versatility since it allows for several physical configurations of the platform, in addition to easiness in assembling and disassembling the modules. Moreover, it should also be mentioned the overall safety offered by the components that constitute such system.

The claimed assembling system has, as a centralizing element, the rectangular block (1). The parallelepiped-shaped rectangular block (1) is connected to the other components through the assembling system, thus configuring the floating platform. There are rings (2) arranged over the rectangular block (1) lateral faces. Each ring is placed at the center of one lateral face of the block, in two different heights in order to enable assembling in different positions.

Since the rings (2) are placed at the center of the rectangular block (1) lateral faces, the assembling can be performed by means of a pin (5), only two blocks at a time, in such a way that the platform assembling gets easier while the overall structure gets more rigid than competing models in the market. The models that enclose the prior art have flanges in all four corners of the block, what leaves to the pin (5) the function of fixing the four blocks at the same time.

The lateral faces of the rectangular block also have cavities (3) and projections (4) (alternatively termed protrusions or saliencies). Both the cavities (3) and the saliencies (4) are arranged in pairs on each one of two of the lateral faces for each rectangular block (1). The cavities (3) and the saliencies (4) constitute one part of the fixing scheme between two rectangular blocks (1) when connecting them to form the platform. The fixation is made by introducing the saliencies (4) into the cavities (3).

Along with the fixation through the cavities (3) and saliencies (4), the assembling system herein exhibited performs the safe junction of the blocks by passing the smaller pin (5) through the rings (2). The smaller pin (5) has a coupling (6) at its bottom end, and grips (8) at its upper end. The grip (8) of the smaller pin (5) passes through the slits (9) placed at the hexagonal structure (10) of the cap (7). By doing so, there will be a connection between the smaller pin (5), the cap (7) and the block (1). Such connection, which configures the main fixation between the blocks (1), can be summarized as follows: The smaller pin (5) uses the coupling (6) to pass through the rings (2) of the blocks (1) being connected. At the upper end, the cap (7), already fitted on the smaller pin (5), is inserted into the semicircles (11), placed at the upper quadrants of the rectangular blocks (1).

To fix the blocks vertically the larger pin (12) (in particular a longer pin) is applied. The employment of the larger (longer) pin (12) follows the same fixation pattern as the smaller pin (5), i.e., it's accomplished by passing of the coupling (6) through the rings (2), then connecting it to the cap (7), and the cap to the semicircle (11) of the blocks (1). The blocks fixation in vertical direction enlarges the possibilities of blocks (1) usage, enabling the assembling of benches, as well as other accessories.

Besides the fixation through the cavities (3), projections (4), rings (2), pins (5 and 12) and cover (7), the modular floating platform system includes a protection bar (13). The protection bar (13) is assembled at the edges of the platform and fixed to the blocks (1) through nuts (14) and bolts (15), connected along the rings (2). The protection bar (13) aims to give greater rigidity to the structure by preventing the flexion movement of the pier when it is submitted to the effect of waves or loads on the surface, as well as to protect against lateral impacts eventually caused to the block (1). An important feature of the protection bar (13) is the existence of two flanges with holes (16) in different height positions, so that one flange may be mounted over the other, consecutively, creating a continuous, stronger structure along the block (1) side.

Another piece of innovation that should be highlighted about the claimed assembling system are the chamfers (17), placed at the upper corners of the rectangular block (1). The chamfers (17) enable the block (1) to be manufactured by the blow process: a master pattern, cast in the form of a vertical pipe (parison) is compressed between the two halves of the mold; the pipe is then inflated with air, assuming the form of the mold. The blow process is different from the rotor-molding process used in the manufacture of plastic floating platform components that enclose the prior art. The blow process prevents the formation of sharp edges in the products, which could affect material thickness and mechanical strength.

For improved finishing of the blocks assembling and enhanced uniformity of the upper surface, free from depressions (18) caused by the collision of four chamfers, a finishing pin (19) has been created. It's placed into hollows (20) immediately under the block (1) chamfer. To allow for such accommodation, the finishing pin (19) has a circular lobule (21) that fits in the aforementioned hollows (20) of the four aligned blocks. The finishing pin (19) may have the upper surface either in the form of a circle or of a rectangle and it can be manufactured as a dense (blow manufacturing process) or ribbed (injection manufacturing process) material.

In order to fully understand the new disposition, the following figures are shown:

FIG. 1—Perspective view of the rectangular block (1)

Figure 2:
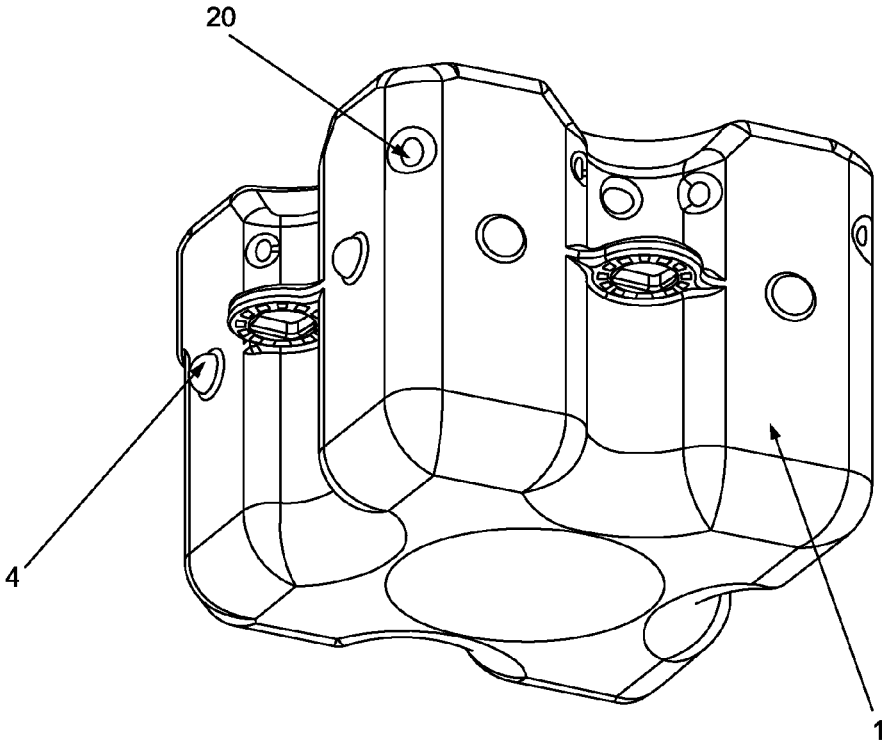

FIG. 2—Low perspective of the block (1)

Figure 3:
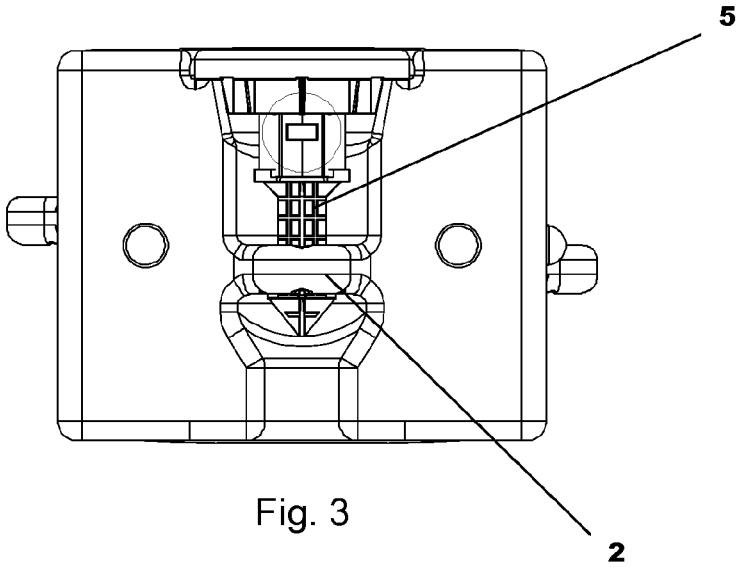

FIG. 3—Side section view illustrating the smaller pin (5) fixation on the rings (2)

Figure 4:
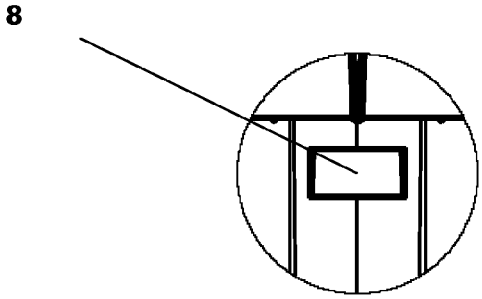

FIG. 4—Separate view of a grip (8) in the slit (9) of the cap (7).

Figure 5:
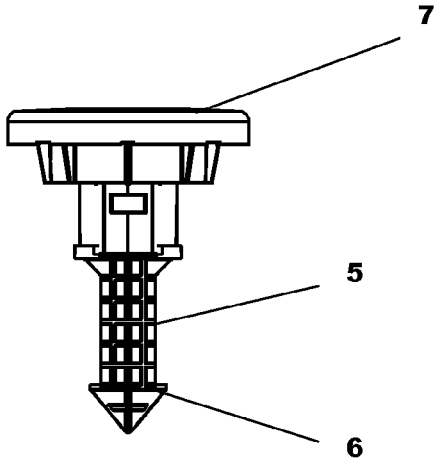

FIG. 5—Separate view of the smaller pin (5) fixed to the cap (7).

Figure 6:
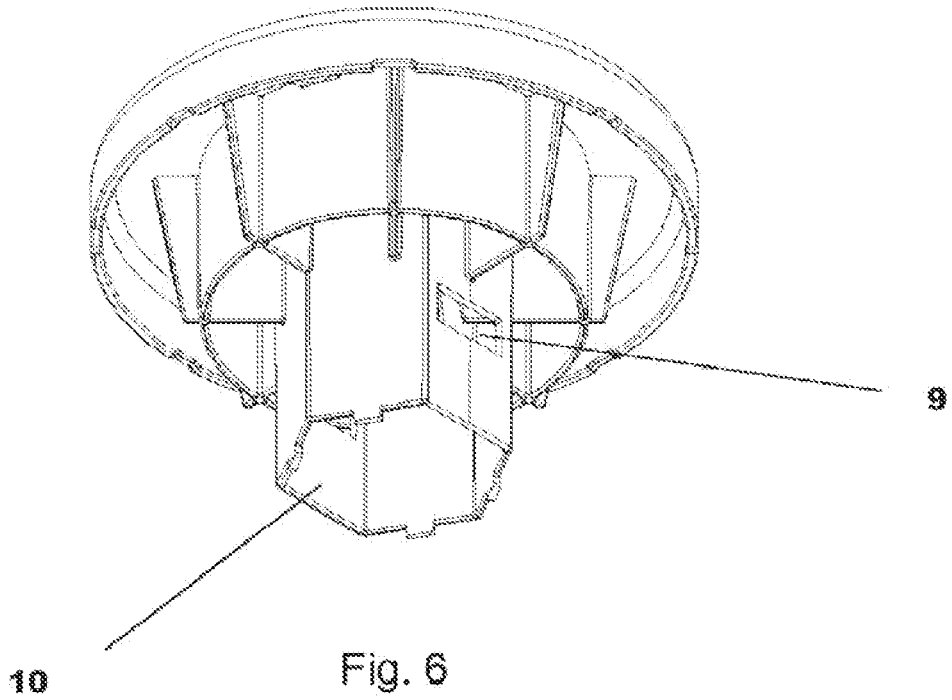

FIG. 6—Lower perspective view of the cap (7).

Figure 7:
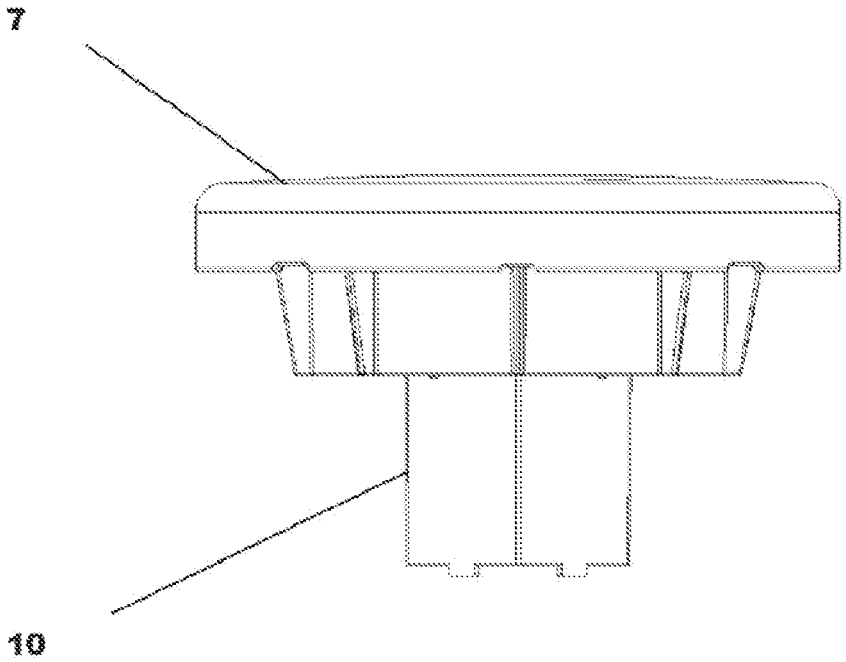

FIG. 7—Side view of the cap (7).

Figure 8:
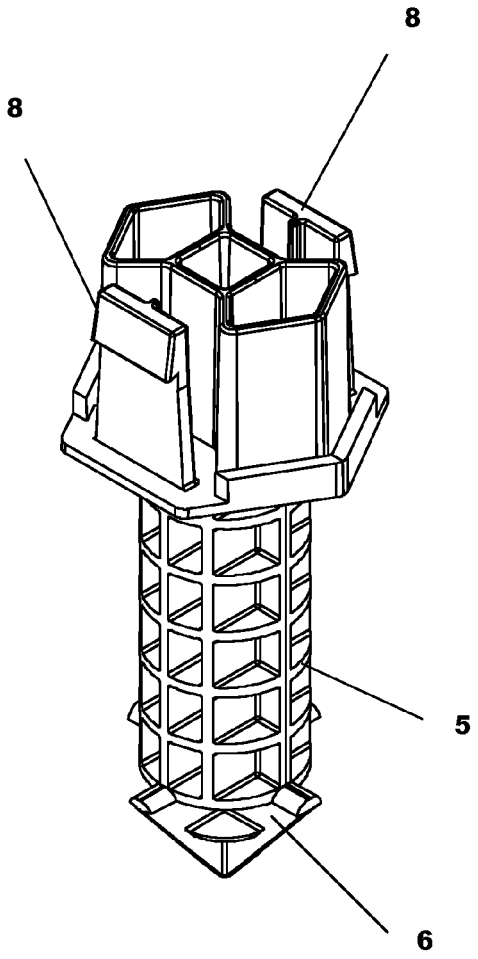

FIG. 8—Separate view of the smaller pin (5).

Figure 9:
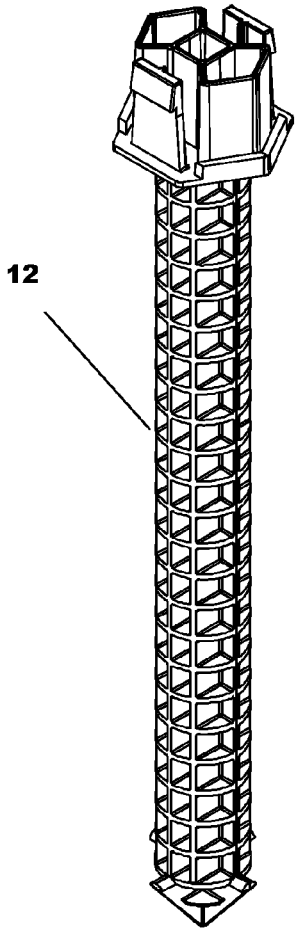

FIG. 9—Separate view of the larger pin (12).

Figure 10:
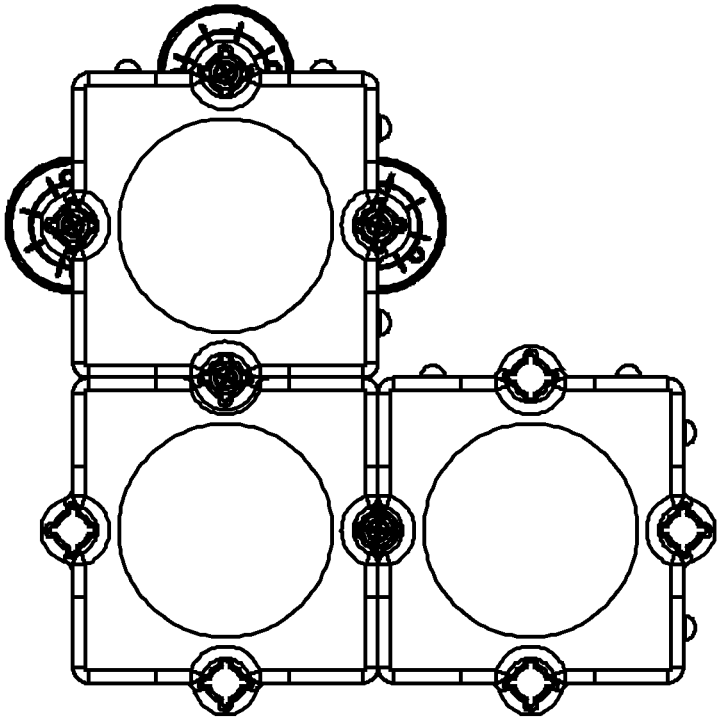

FIG. 10—Upper view showing the vertical assembling of blocks through the large pins (12) fixation.

Figure 11:
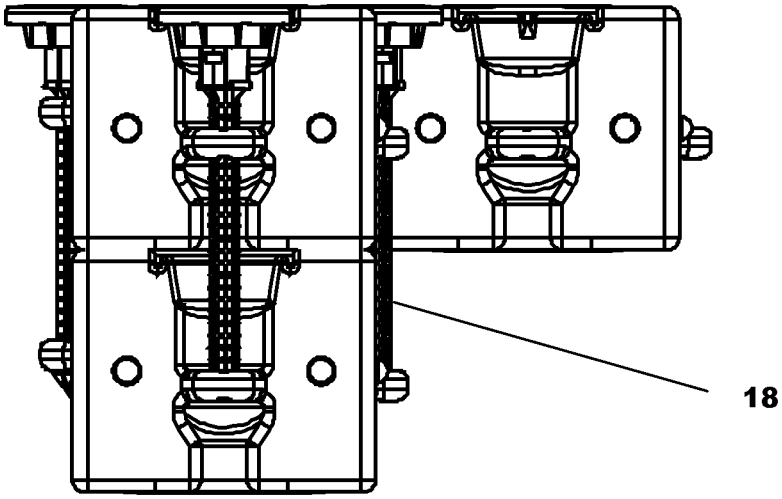

FIG. 11—Side view showing the vertical assembling of blocks through the larger pins (12) fixation.

Figure 12:
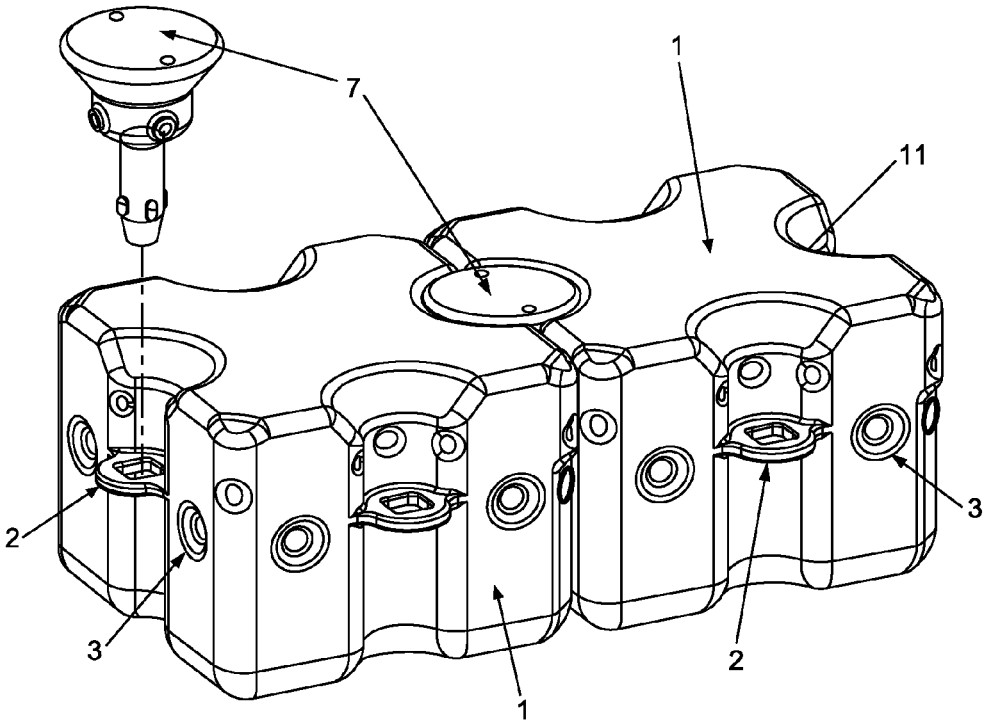

FIG. 12—Perspective view illustrating the assembly between two blocks (1).

Figure 13:
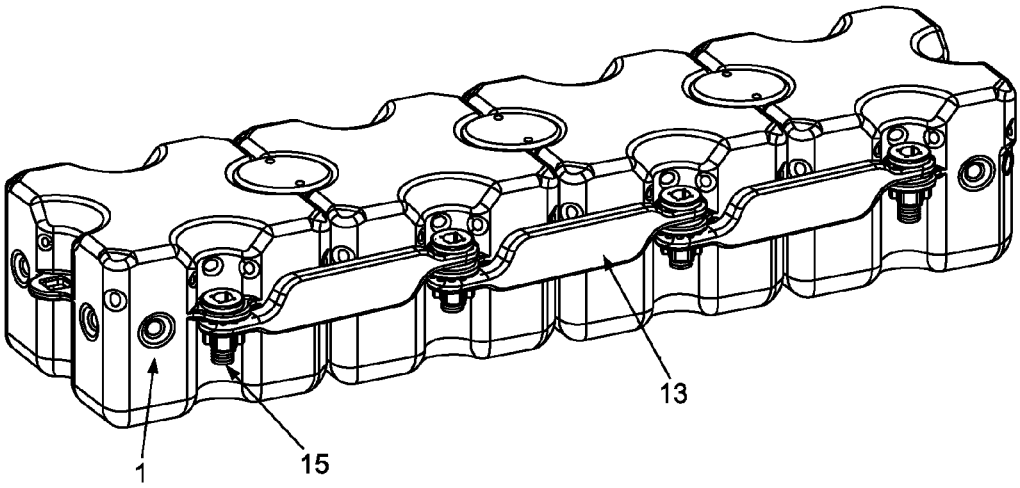

FIG. 13—Perspective view showing the protection bars (13) in the assembly.

Figure 14:
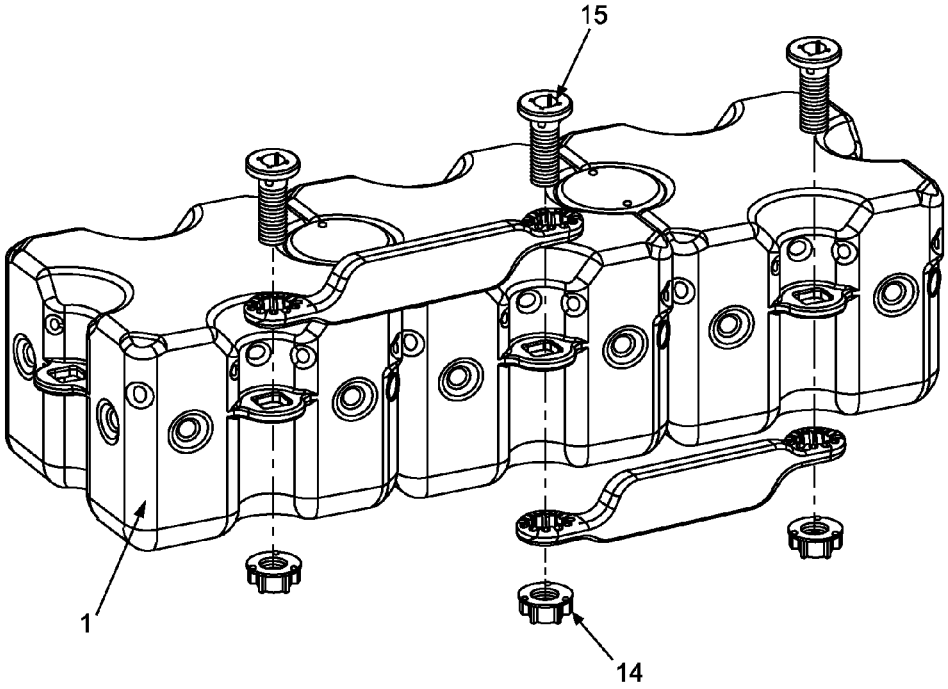

FIG. 14—Detailed view highlighting the protection bar (13).

Figure 15:
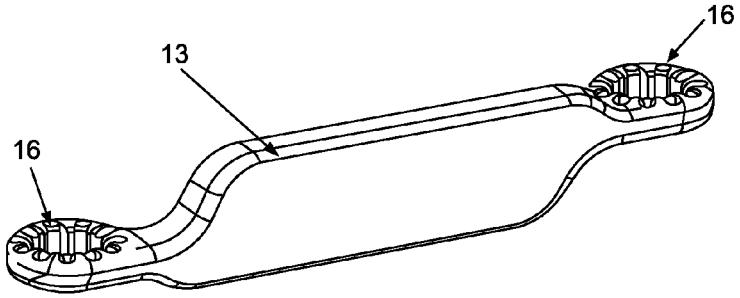

FIG. 15—Separate view of the protection bar (13).

Figure 16:
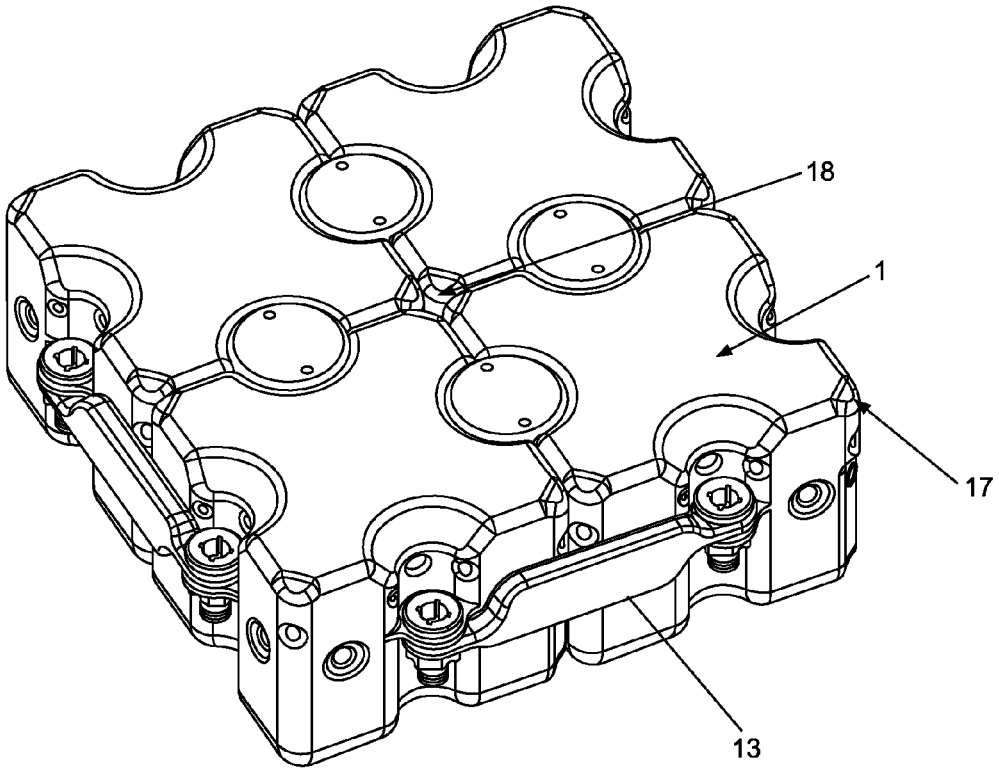

FIG. 16—Upper perspective view highlighting the depression (18).

Figure 17:
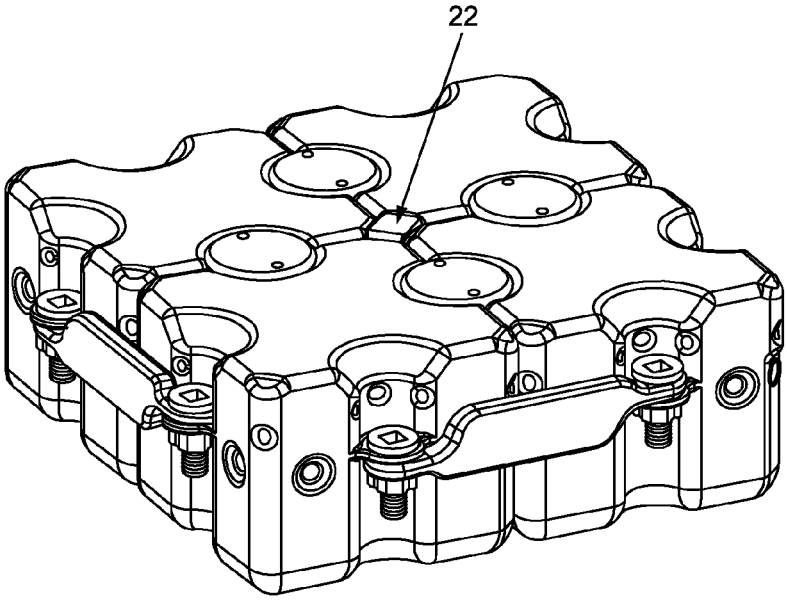

FIG. 17—Upper perspective view highlighting the upper surface (22) of the finishing pin (19).

Figure 18:
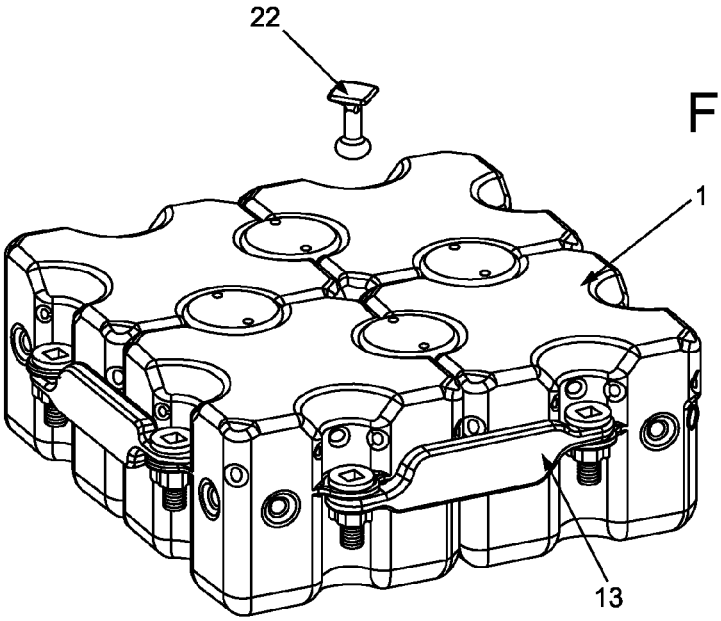

FIG. 18—Upper perspective view.

Figure 19:
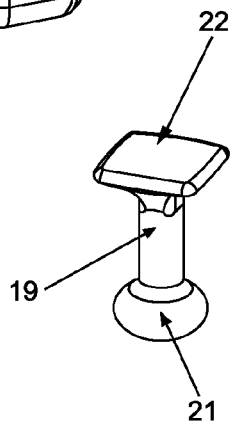

FIG. 19—Separate view of the finishing pin (19).

Figure 20:
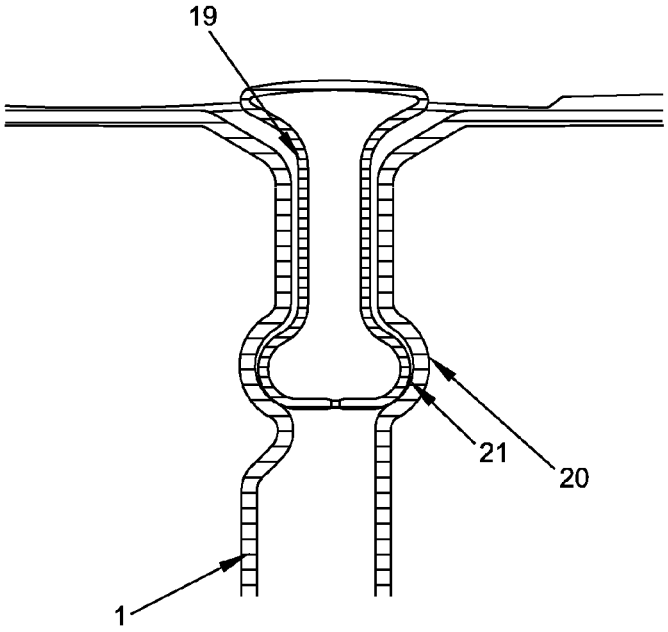

FIG. 20—Section view showing the insertion of the circular lobule (21), of the finishing pin (19) into the hollow (20) of the block (1).

As it may be verified, the new "disposition introduced into assembling system for floating platforms" presents a creative concept that makes it different from the prior art. Its functional features offer advantages to the target industrial sector, and this grants it the patent right.

The invention claimed is:

1. A modular floating platform system having securely interconnected rectangular floating blocks, comprising:

a plurality of rectangular blocks comprising plastic material, attachable to one another to form a floating platform, each rectangular block having a substantially parallelepiped shape with a plurality of lateral faces;

semicircles formed in an upper portion of each rectangular block with a semicircle arranged in each quadrant of the rectangular block;

chamfers formed in each upper corner of the rectangular blocks;

rings centrally placed on the lateral faces of the rectangular blocks;

cavities arranged in pairs on two of the lateral faces of the rectangular blocks;

projections arranged in pairs on the remaining ones of the lateral faces of the rectangular blocks, a pair of the projections on one of the rectangular blocks being configured to be mated with a corresponding pair of the cavities on an adjacent one of the rectangular blocks;

pins configured to be inserted into the rings to attach the adjacent blocks together, each pin comprising a plurality of grips in an upper portion and a coupling in a lower portion thereof;

caps comprising a hexagonal structure with slits, the caps being configured to connect to the upper portion of the pins, wherein the grips of the pins are arranged to couple with the slits of the hexagonal structure of the caps, and wherein the caps are arranged to be inserted in the semicircles of the adjacent rectangular blocks.

2. The modular floating platform system of claim 1, further comprising protection bars fixed to edges of the platform.

3. The modular floating platform system of claim 2, wherein the protection bars are fixed by nuts and bolts coupled to the rings of the blocks.

4. The modular floating platform system of claim 1, further comprising finishing pins having circular lobules received in hollows under the chamfers.

5. The modular floating platform system of claim 4, wherein the finishing pins having an upper surface with one of a circular and rectangular shape.

6. The modular floating platform system of claim 1, wherein said pins are configured for attaching laterally adjacent ones of the blocks together, and further comprising additional pins configured for attaching vertically ones of the blocks together.

7. The modular floating platform system of claim 6 wherein the additional pins are longer than the pins configured for attaching the laterally adjacent ones of the blocks.

* * * * *